US006216496B1

(12) United States Patent
Gehring

(10) Patent No.: US 6,216,496 B1
(45) Date of Patent: Apr. 17, 2001

(54) HIGH PERFORMANCE HOOK AND LOOP CLOSURE SYSTEM

(75) Inventor: Gregory Gehring, Baldwin, NY (US)

(73) Assignee: Gehring Textiles, Inc., New York, NY (US)

( * ) Notice: Subject to any disclaimer, the term of this patent is extended or adjusted under 35 U.S.C. 154(b) by 0 days.

(21) Appl. No.: 09/148,252

(22) Filed: Sep. 4, 1998

(51) Int. Cl.[7] ..... D04B 21/02
(52) U.S. Cl. ..... 66/191; 66/192; 66/195
(58) Field of Search ..... 66/169 R, 170, 66/190, 191, 192, 193, 194, 195; 24/445, 446, 449

(56) References Cited

U.S. PATENT DOCUMENTS 4,338,800 * 7/1982 Matsuda ..... 66/194
4,677,011 * 6/1987 Matsuda ..... 428/88
4,705,710 11/1987 Matsuda .
4,709,562 * 12/1987 Matsuda ..... 66/193
4,858,447 * 8/1989 Matsuda ..... 66/191
4,881,383 * 11/1989 Spillane et al. ..... 66/194
4,894,060 1/1990 Nestegard .
5,019,073 5/1991 Roessler et al. .
5,065,600 * 11/1991 Byles ..... 66/193
5,449,530 * 9/1995 Peake, III et al. ..... 427/244
5,656,351 8/1997 Donaruma .
5,838,044 * 11/1998 Chang et al. ..... 257/369

* cited by examiner

*Primary Examiner*—Danny Worrell
(74) *Attorney, Agent, or Firm*—Gottlieb, Rackman & Reisman, P.C.

(57) ABSTRACT

A warp knit fabric for use as a loop member in a hook and loop closure system is provided. The wrap knit fabric comprises a base yarn and a pile yarn, the pile yarn being a high tenacity monofilament yarn with a denier of between about 50 and 200. The pile yarn defines loop that are generated during knitting and these loops are oriented at varying random angles to one another.

10 Claims, 2 Drawing Sheets

HIGH PERFORMANCE HOOK AND LOOP CLOSURE SYSTEM

BACKGROUND OF THE INVENTION

This application relates to a high performance hook and loop closure system, and more particularly, to a warp knit fabric for use as a loop member in a hook and loop closure system.

Hook and loop closure systems, frequently referred to as Velcro® systems, have been known and extensively used for decades. Such closure systems, in their usual form, consist of multifilament loop pile members and monofilament hook members. The hook members may be selectively mated together, which is typically achieved by finger pressure, in order to cause the hook members to engage the loop members, thereby producing a secure, yet reversible joint or closure. This connection of the hook and loop members can be discontinued by pulling the two members apart.

In general, a loop member for carrying a plurality of pile loops is normally produced by a process of napping on appropriately constructed woven or knit fabric.

Hook and loop closure systems are used in clothing, upholstery, sporting goods, orthopedic and medical devices, as well as other applications where a certain amount of force is required to keep a pair of component parts together.

For industrial, technical or specialty applications, where the stress on closure components may be quite substantial, stronger yarns, which are configured into unique forms, must be used in order to withstand the high forces that may be involved. One such example is a sanding tool. Here, a disposable sanding pad, provided with a hooked surface on its non-abrasive side, is applied to the rotating part of the tool which is covered with loop fabric, in order to firmly hold the pad in position. This is achieved by mating the hooks of the sanding pad with the loops of the tool so as to effect a secure bond which is able to withstand the stress of high speed sanding. Once the pad is worn and is otherwise in need of replacement, it is simply peeled off and discarded.

As can be appreciated, the loop members of the sanding tool must be strong and durable enough to last through a large number of cycles of pad replacement without any deterioration in their holding power. Accordingly, it would be desirable to provide a loop pile fabric that is suitable for use in a sanding tool as described above, or other high performance applications.

SUMMARY OF THE INVENTION

Generally speaking, in accordance with the invention, a warp knit fabric for use as a loop member in a hook and loop closure system is provided. The warp knit fabric comprises a base yarn and a pile yarn, the pile yarn being a high tenacity monofilament yarn with a denier of between about 50 and 200. The pile yarn defines loops that are generated during knitting. These loops are oriented at varying random angles to one another.

Accordingly, it is an object of the invention to provide an improved hook and loop closure system.

Still another object of the invention is to provide a warp knit loop pile fabric.

Yet a further object of the invention is to provide a warp knit fabric having a loop member in a hook and loop system in which the pile or loop yarn is disposed in a non-linear random configuration.

Other objects and advantages of the invention will in part be obvious and will in part be apparent from the following description.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENT

The warp knit fabric of the invention is preferably made on a warp knitting machine. As a result, the pile loops thereof may be anchored in the base structure more securely then with any other type of fabrication technique such as weaving or tufting.

The warp knit fabric of the invention includes a base structure comprising a base yarn and a pile structure comprising a pile yarn. The pile yarn defines pile loops which are anchored to the base structure. The pile yarn is a high tenacity monofilament yarn of at least 7 grams/denier with a denier of between about 50 and 200. The pile yarn defines loops that are generated during knitting which are oriented at varying angles to one another.

The pile yarn is selected from nylon and polyester. The pile yarn loops have a density of between about 300 and 500 loops per square inch. The loops have a height of between about 2.0 and 3.0 milimeters. Preferably, substantially all of the loops have a substantially uniform height.

The base yarn is textured polyester to render the base as impermeable as possible, and the base yarn has a denier of between about 70 and 150.

As discussed above, in order for the fabric of the invention to have sufficient loop adhesion with the hooks, the pile thereof must be non-directional with the loops oriented at different angles to one another. This produces a suitable "hook" holding effect, regardless of, for example, how a sanding pad would be placed in the tool and the manner or angle at which the tool is applied to the surface being sanded.

The base structure fabric of the invention may be back coated with a variety of materials to render the fabric stable and better anchor the loop elements of the pile.

The base structure of the fabric is preferably dense and impermeable in order to prevent the back coating that may be applied from striking through the base interstices.

A high denier monofilament yarn is used for the pile or loops, which enables the yarn to securely engage the hook elements, but still permit their ready disengagement from the loops in the course of removal.

The use of heavy denier, high-tenacity multifilament yarn configured into a dense warp knit pile will create an especially strong bonding effect with the hook elements of the closure system. In contrast, conventional prior art systems use fine denier multifilament yarns as a loop element, and are produced via a post-knitting process such as napping, rather than integrally in the knitting process.

The base structure of the inventive fabric is knit on two guide bars (the back and middle bars), while the pile structure is knit on the front guide bar. In certain situations, the base structure may be knit either with one guide bar or with more than two guide bars, depending on the desired weight, stability, density and other features of the base structure.

Figure 1:
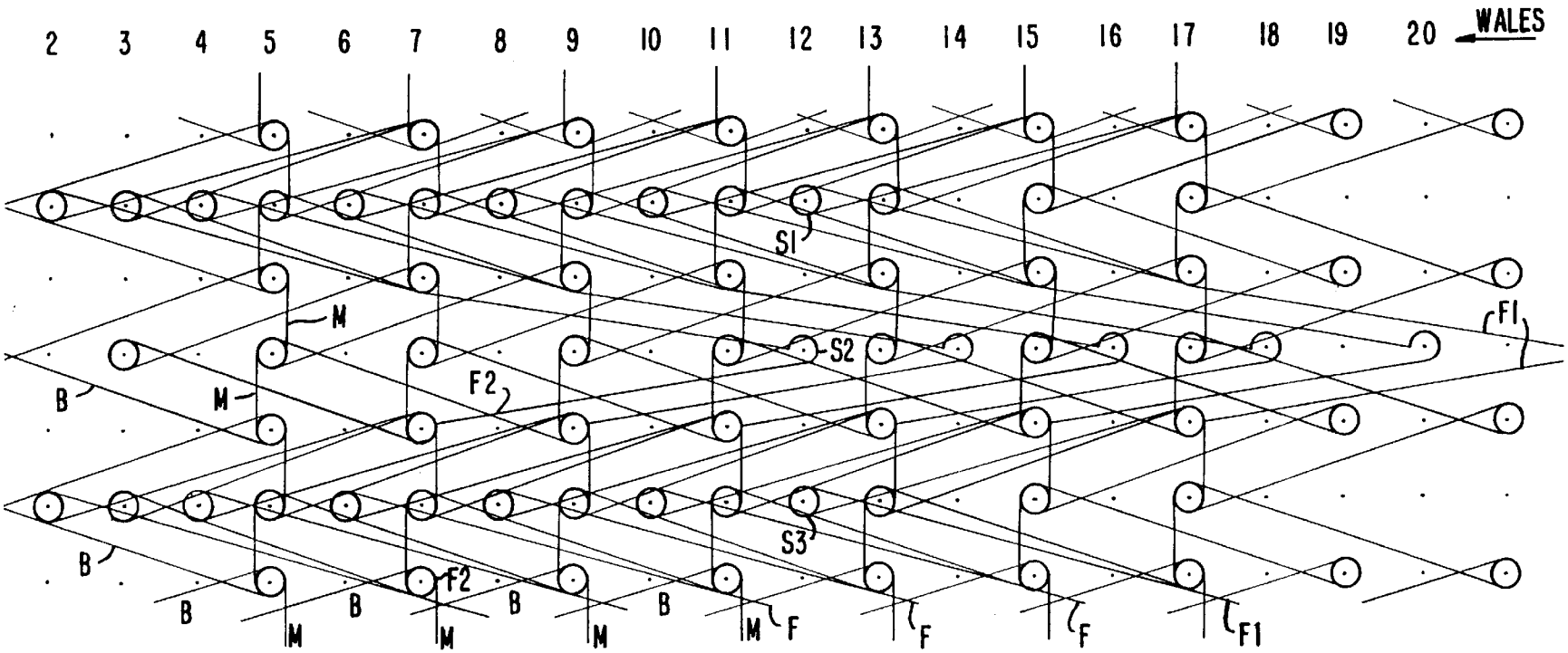
FIG. 1 is a schematic view of the threading of the guide bars and their stitch forming movement in order to construct the fabric of the invention.
Figure 2:
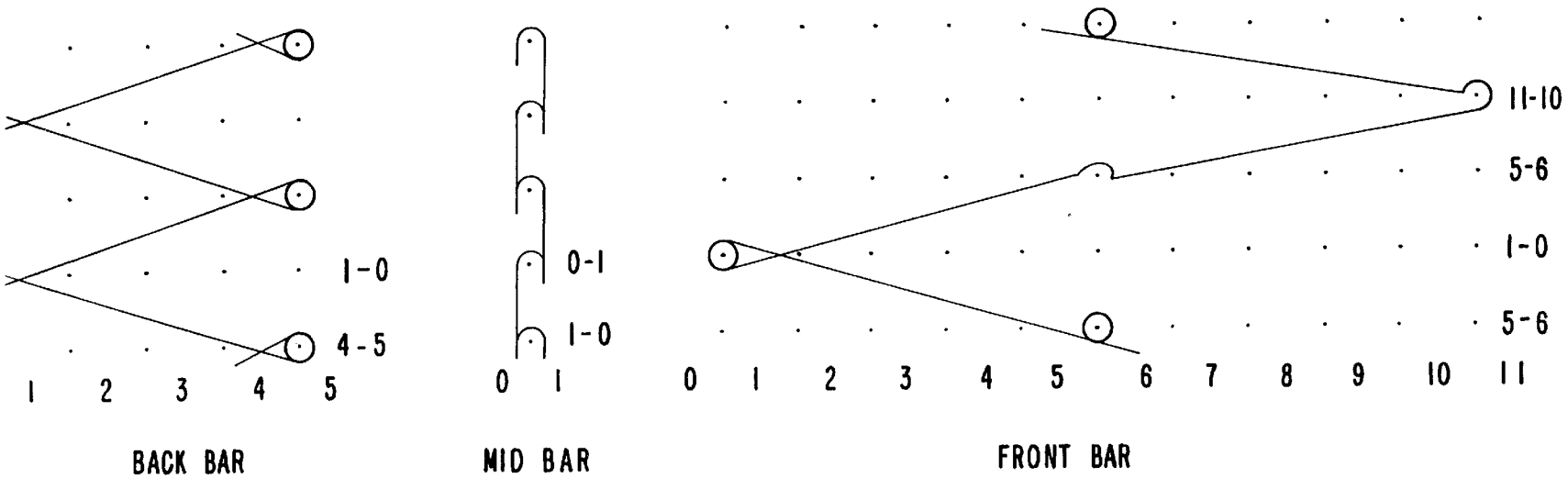
FIG. 2 is a digital notation view of guide bar movement.

FIG. 1 depicts a preferred stitching construction for the inventive fabric. FIG. 2 is a schematic representation of guide bar movement, and the numbers indicated thereon represent the digital notation for each guide bar. As can be appreciated, each guide bar is threaded in an order of one-in, one-out, meaning that the alternate guides are left empty. The resulting fabric structure is depicted schematically in FIG. 1.

Still referring to FIGS. 1 and 2, back bar threads B, combined with middle bar threads M, knit a base structure on alternate needles, on which fabric wales are formed. As shown, wales are formed on odd needles 1, 3, 5, 7 . . . 19, and are not formed on even needles 2, 4, 6, 8 . . . 20.

As shown on FIGS. 1 and 2, the movement of 1-0, 4-5 on the back bar and 0-1, 1-0 on the middle bar has been selected in order to produce a base structure with a good amount of stability without having excess weight. Alternatively, a denser, heavier ground structure may be knit with a movement of 1-0, 4-5 on one bar and 4-5, 1-0 on the other. Such a system would be mathematically expressed by the following knitting formula: 1-0, N-(N+1) where N is an even number. For example, if N=6, the movement by one bar would be 1-0, 6-7 and for the other bar, 6-7, 1-0.

The pile structure of the inventive fabric is generated by means of the "press-off" principle. As shown in FIGS. 1 and 2, pile yarn F, carried on the front bar, knits on one course on the odd needles forming the base, and on the next course, on the even empty needles in order to draw stitches. On subsequent courses, these stitches will be cast or pressed off the needles, because there will be no new stitches to support them. This is clearly shown on needle 12 (see FIG. 1), where the front bar thread F1 draws a stitch S1 on course 2, which is then pressed off on course 3 into a protruding pile loop. On the other hand, on course 4, another stitch S2 is drawn on needle 12 by thread F2 and pressed off on course 5 into a pile loop. On course 6, the next stitch S3 is drawn by thread F1 and pressed off on course 7. Accordingly, the loop pile structure of the inventive fabric is formed by drawing stitches with the front bar threads on the empty even needles on even courses, and pressing them off on the odd courses.

In accordance with the invention, the front bar movement has been designed in order to produce a non-directional pile in which the loops point in different random directions. Thus, stitches S1 and S3 are drawn with a so-called "closed lap," while stitch S2 is drawn with an "open lap." This difference in lap configurations enables the pile loop to have a non-directional orientation. This non-directional orientation is further enhanced during wet processing of the fabric, as described later on. Suffice it to say that the adaption of the tumbling action of the jet that is used during wet processing distorts the loop piles into a random arrangement.

As can be appreciated, pile density loop height, and pile orientation may be varied by suitably designing the below. movement of the guide bars. Two examples are provided

| | Back Bar | Middle Bar | Front Bar |
|---|---|---|---|
| Example 1. | 4–5 | 1–0 | 3–4 |
| | 1–0 | 0–1 | 1–0 |
| | | | 3–4 |
| | | | 7–6 |
| Example 2. | 4–5 | 1–0 | 3–4 |
| | 1–0 | 0–1 | 1–0 |
| | | | 5–6 |
| | | | 9–8 |

The fabric in Example 1 will render a lower height pile loop than that described in Example 2. The higher pile loops in Example 2 will be disposed in well-oriented, parallel rows.

Thus, an extensive variety of loop pile fabrics may be generated using the above techniques in order to produce fabric products having the desired weight, loop height, density, strength, stability and other features necessary for carrying out the invention.

Once the fabric of the invention has been knit, it is scored in a high temperature jet processing machine. Here, the yarn oils and finishes which draw surface dirt are removed and the ground structure is allowed to consolidate under the influence of the hot water and jet agitation. Also, the jet action disorients the loop piles, as described above.

After scouring, the fabric is heat-set on a tenter frame, which imparts further dimensional stability.

In summary, the inventive fabric includes a dense, stable, low-permeability base structure with loop pile, creating a powerful loop-anchoring effect which resists the pulling forces of the hook members of the closure system.

The fabric of the invention is made, for example, on a 28 needles/inch tricot or raschel machine. The machine is programmed to generate a stitch construction.

The invention accordingly comprises the features, construction and arrangement of parts described herein, and the scope of the invention is identified in the claims.

What is claimed is:

1. A warp knit fabric for use as a loop member in a hook and loop closure system comprising a base structure formed from base yarn and a pile structure formed from pile yarn, the pile yarn being a high-tenacity monofilament yarn of at least 7 grams/denier with a denier of between about 50 and 200 and a height of between 2.0 and 3.0 millimeters, the pile yarn defining loops anchored to the base structure and being oriented at varying angles to one another.

2. The fabric of claim 1, wherein the pile yarn is selected from the group consisting of nylon or polyester.

3. The fabric of claim 1, wherein the base yarn has a denier of between about 70 and 150.

4. The fabric of claim 1, wherein said loops have a density of between about 300 and 500 loops per square inch.

5. The fabric of claim 1, wherein the loops have a substantially uniform height.

6. The fabric of claim 1, wherein said base yarn is textured polyester.

7. The fabric of claim 1, wherein said base structure is back coated.

8. The fabric of claim 1, wherein said base structure is knit along two guide bars and said pile structure is knit along a third guide bar.

9. The fabric of claim 8, wherein guide bar movement of each of said two guide bars is expressed by the formula: 1-0, N-(N+1) wherein N is an even number.

10. The fabric of claim 8, wherein guide bar movement of said third bar produces a random pile structure.

* * * * *